US008720738B1

(12) United States Patent
Ryman

(10) Patent No.: US 8,720,738 B1
(45) Date of Patent: May 13, 2014

(54) UNIVERSAL COVER ASSEMBLY FOR COMMERCIAL AND RESIDENTIAL PROPANE TANKS

(76) Inventor: Maurice Ryman, Shohola, PA (US)

( * ) Notice: Subject to any disclaimer, the term of this patent is extended or adjusted under 35 U.S.C. 154(b) by 1098 days.

(21) Appl. No.: 12/661,116

(22) Filed: Mar. 11, 2010

Related U.S. Application Data

(60) Provisional application No. 61/210,477, filed on Mar. 18, 2009.

(51) Int. Cl.
*B65D 43/00* (2006.01)

(52) U.S. Cl.
USPC ..... 220/724

(58) Field of Classification Search
CPC ..... F17C 13/06; F17C 13/084; F17C 13/022
USPC ..... 215/235, 216, 245, 272, 225, 221, 240, 215/317, 237, 236; 16/387, 388, 389, 390, 16/392, 366, 365, 250; 220/318, 581, 728, 220/724; 137/382
See application file for complete search history.

(56) References Cited

U.S. PATENT DOCUMENTS

| | | | | |
|---|---|---|---|---|
| 3,185,326 | A | 5/1965 | Goss | |
| 3,722,533 | A * | 3/1973 | Connolly | 137/382 |
| 5,238,141 | A | 8/1993 | Callegari et al. | |
| 5,690,141 | A | 11/1997 | Creaghe | |
| 6,247,491 | B1 | 6/2001 | Petryna | |
| 6,301,747 | B1 * | 10/2001 | Parein | 16/260 |
| 6,478,183 | B1 * | 11/2002 | Bacon et al. | 220/784 |
| 7,322,487 | B1 | 1/2008 | Hill | |

* cited by examiner

*Primary Examiner* — J. Gregory Pickett
*Assistant Examiner* — Kevin Castillo
(74) *Attorney, Agent, or Firm* — Sandra M. Kotin

(57) ABSTRACT

A cover assembly that can be used with all large commercial and residential propane tanks includes a lid proportioned to fit over the collar of the propane tank, an adapter to permit pivotal attachment of the lid to the collar, a cotter pin to enable the lid to pivot opened and closed, and attaching rivets to secure the adapter to the collar. There is also a button that can be attached to the collar to maintain the lid in closed orientation. The lid can be made in a range of sizes to accommodate all large commercial and residential propane tanks currently in service. A single adapter able to conform to the curvature of the collars of all sizes of the propane tanks can be used with all of the lids.

8 Claims, 3 Drawing Sheets

UNIVERSAL COVER ASSEMBLY FOR COMMERCIAL AND RESIDENTIAL PROPANE TANKS

This application discloses substantially the same invention disclosed in Provisional Patent Application Ser. No. 61/210,477 filed on Mar. 18, 2009.

FIELD OF THE INVENTION

The instant invention relates to a cover assembly to be used with large commercial and residential propane tanks and accommodates tanks covering a range of sizes and those emanating from different manufacturers.

BACKGROUND OF THE INVENTION

In U.S. Pat. No. 3,185,336, Goss discloses a cover assembly designed to completely enclose and protect the valves on tanks used to contain noxious and inflammable gases and liquids. A circular collar with a front locking lug and rear projecting guide lugs is welded to the cylinder around the valves. Openings in the bottom of the collar permit drainage of water that may accumulate within the enclosure. A cylindrical cap with a flat top and circumference slightly larger than the collar fits down over the collar. The cap is hingedly attached to the rear guide lugs and can be padlocked through the front locking lug. The design is such that even if the hinge bolt is removed, the cap cannot be lifted to expose the valves with the padlock in place.

Callegari et al., in U.S. Pat. No. 5,238,141, teaches a locking cover for liquid propane tanks. This cover is designed for propane tanks having a fully exposed valve and no attached collar. A circular base plate having a slot is slipped around the valve and sits on the shoulder of the tank. A hinged cup shaped cap rotates down to the base plate and completely encloses the valve. A lock flange on the base plate cooperates with a flange on the cap to accommodate a padlock to secure the valve. An additional locking ring can be added to prevent anyone from reaching in through the slot to contact the valve.

The valves of tanks used to ship and store a variety of chemicals can be protected by a cover assembly having a collar that is rigidly attached to the tank. A lid is attached to the collar by a hinge designed with a stop means such that the hinge can be opened to an upright position but will not flop backward to hit the side of the tank. There are several sets of pivotally attached bolts that cooperate with sets of flanges on the lid to seal and maintain the lid closed. An O-ring can be fitted into the lid to completely seal the valve area. This assembly is taught by Creaghe in U.S. Pat. No. 5,690,141.

Petryna teaches a child proof cover for compressed gas valves for the smaller tanks commonly used with home barbecue systems. The cover is a cylindrical housing formed in two hinged sections that clamp together around the valve. The sides of the housing taper downward so that once clamped in place it cannot be lifted to expose the valve. An opening in the side of the housing permits the regulator to extend out of the housing while the valve is totally within the housing. A top is hinged to the housing and various embodiments require a rotation of the top to gain access to the valve. (U.S. Pat. No. 6,247,491)

A dual purpose propane tank cover assembly is taught by Hill in U.S. Pat. No. 7,322,487. This assembly is for use with small propane tanks used with home barbecues and enables the propane tank to be used as a table while protecting the tank's valve system. A cap fits within the tank's collar and cooperates with the slots in the sides of the collar to completely enclose the valves. There is also a hinged outer collar that locks around the tank collar and supports a circular plate that extends above the collar. A round table top with a track mounted on its underside fits over the plate and prevents the table top from shifting. This assembly creates a table which can be covered with a cloth to completely hide the tank.

There is a need for a single cover assembly for large commercial and residential propane tanks that can be used with the tanks of all manufacturers. There is a need for such a cover that can be taken from one tank and used on another tank of the same size made by the same or a different manufacturer. There is a need for a tank cover assembly that will not rust or corrode and enables the cover to be hingedly attached to the propane tank and remain closed to protect the valves and gauges.

BRIEF SUMMARY OF THE INVENTION

The present invention provides a cover assembly for large commercial and residential propane tanks. The cover assembly can be used with propane tanks coming from all current manufacturers.

It is an object of the present invention to provide a propane tank cover assembly that can be used with all sizes of large commercial and residential propane tanks.

It is another object of the present invention to provide a propane tank cover assembly that enables the cover to be hingedly attached to all of the propane tanks.

A further object of the present invention is to provide a propane tank cover that will remain securely in place and cannot be dislodged even in high winds.

A still further object of the present invention is to provide a propane tank cover that is easy to attach to any large commercial and residential propane tank.

Another object of the present invention is to provide a propane tank cover assembly with few parts.

An object of the present invention is to provide a propane tank cover that cannot rust, corrode or break down even when exposed to the elements for considerable time periods.

Another object of the present invention is to provide a propane tank cover assembly that is lightweight and is not easily damaged.

A still further object of the present invention is to provide a propane tank cover assembly that includes all parts necessary to hingedly install the cover on any large commercial and residential propane tank.

A further object of the present invention is to provide a lid that can be made in a range of sizes while cooperating with the same assembly parts and attaching means.

The invention is a cover assembly for use with large commercial and residential propane tanks of a type that are free standing cylinders bounded by substantially flat upper and lower surfaces and having a cylindrical collar of lesser diameter than the cylinder permanently affixed to a central portion of the upper surface. The cover assembly comprises a lid configured to cover the inside of the cylindrical collar, the lid comprising a disc having a top surface, a bottom surface, and a downward facing annular flange integral with its outer edge, the annular flange configured to enclose the upper rim of the cylindrical collar, a handle, integral with and disposed on the front outer surface of the annular flange, and a hinge assembly integral with and disposed on the rear outer surface of the annular flange, the hinge assembly having communicating horizontally oriented apertures therethrough. There is an adapter to enable the lid to be hingedly attached to the cylindrical collar which comprises a semi-rigid plate having at least two openings through which to attach the plate to the outside of the cylindrical collar and two vertical ears integral with and at right angles to the plate, the ears having horizontally oriented apertures and configured for communication with the horizontal apertures of the hinge assembly, a pin configured to pass through the apertures in the hinge assembly and the apertures in the ears such that the lid can pivot upward to expose the interior of the cylindrical collar and can pivot downward to protect the interior, a cylindrical button having a substantially flat bottom, a domed top and an axial bore for attachment of the button to the cylindrical collar, and an opening in the front of the annular flange of the lid configured to accept the button.

The invention is also a cover assembly for use with large commercial and residential propane tanks of a type that are free standing cylinders bounded by substantially flat upper and lower surfaces and having a cylindrical collar of lesser diameter than the cylinder permanently affixed to a central portion of the upper surface, wherein the cover assembly comprises a lid configured to cover the inside of the cylindrical collar and to enclose the upper rim of the cylindrical collar the lid comprising a disc having a top surface, a bottom surface, and a downward facing annular flange integral with its outer edge, the annular flange configured to enclose the upper rim of the cylindrical collar, a handle integral with and disposed on the front outer surface of the annular flange and a hinge assembly integral with and disposed on the rear outer surface of the annular flange opposite said handle. There is an adapter to enable the lid to be hingedly attached to the cylindrical collar, the adapter having at least two holes therethrough for attachment to the cylindrical collar and two vertical ears for cooperation with said hinge assembly, a pivot pin in communication with said hinge assembly and the ears of the adapter for enabling the lid to pivot opened and closed over the cylindrical collar, a cylindrical button having an axial bore for attachment of said button to the cylindrical collar, and an opening in the front of the annular flange configured to accept the button. The lid is composed of a semi-rigid material thereby enabling the lid to distort sufficiently for the annular flange to pass over the button and to return after the button snaps into the opening in the front of the annular flange so as to maintain the lid in closed orientation.

Other features and advantages of the invention will be seen from the following description and drawings.

DETAILED DESCRIPTION OF THE INVENTION

Figure 1:
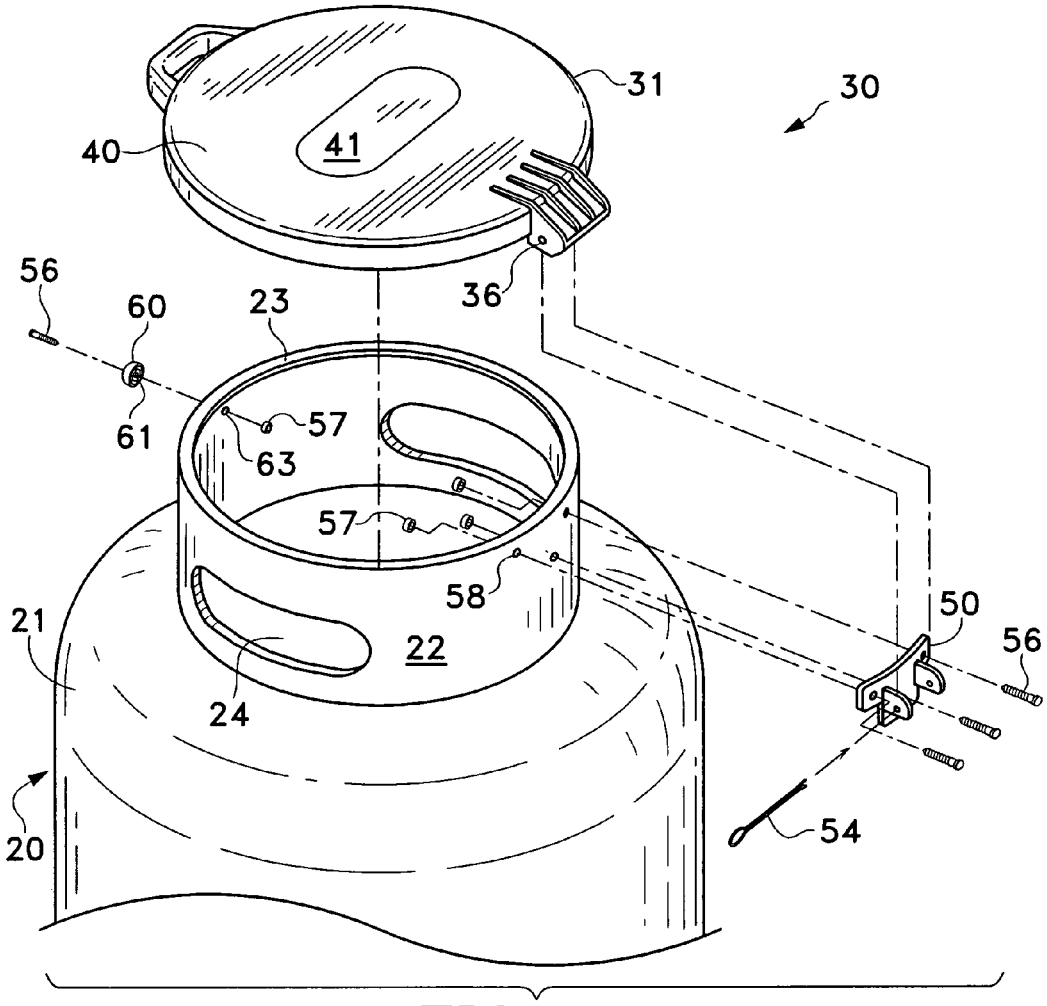
FIG. 1 is a perspective exploded view of the propane tank cover assembly of the present invention.
Figure 2:
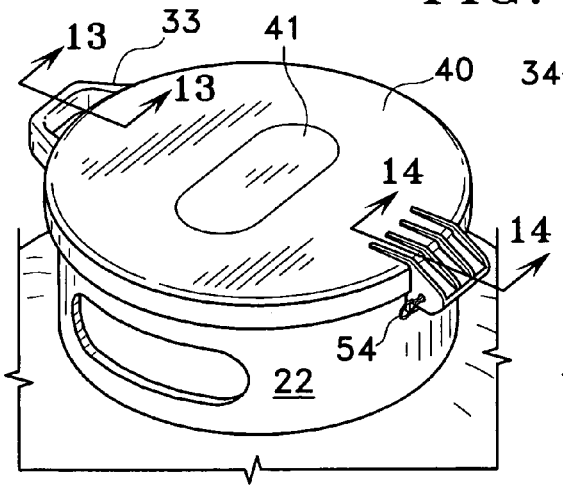
FIG. 2 is a rear perspective view of the propane tank cover assembly with all parts in place on a propane tank.

There are a limited number of manufacturers of large commercial and residential propane tanks and each manufacturer's tank may utilize a different lid or cover assembly. These propane tanks 20 are in the form of large free standing cylinders 21 having a round iron collar 22 affixed to the top of the cylinder as seen in FIG. 1. This collar 22 may surround the various valves and gauges (not illustrated) through which the tank's contents are accessed. The upper rim 23 of the collar may be slightly higher than the uppermost edges of the valves and gauges. The collar may have lateral openings 24 through opposing sides. The collar 22 may protect the enclosed valves and gauges from the sides, but a lid may be necessary to protect them from the elements and any possible injury from above the tank. The most common lid (not illustrated) is made of metal, is slightly domed and has a downward facing flange that encloses the upper portion of the collar. Some of the lids are attached to the collar by various types of hinges, flexible bands, or other attachment means, while some lids may merely rest on the rim of the collar without any means of attachment. Each tank manufacturer may have its own lid and means of attachment, and the lid of one manufacturer generally cannot be used with tanks made by another manufacturer.

The present invention may be a cover assembly 30 which can accommodate any of the large propane tanks 20. This cover assembly 30 may be made to accommodate the eight sizes of this type of propane tank 20 now in use, but it may also be made in a wider range of sizes in keeping with the following disclosure. The variously sized propane tanks may have proportionately sized collars and the diameter of the collar may determine the diameter of the lid supplied by the current manufacturers. This diameter may also determine the diameter of the lid that is a part of the cover assembly described herein.

The cover assembly 30 of the present invention may include a lid 31, an adapter 50, a fastening button 60, a cotter pin 54 and attaching means 56 which may be rivets or bolts and nuts 56, 57, all seen in FIG. 1.

The lid 31 may be substantially a disc having an integral downward facing circular flange 32 that may be dimensioned to encircle the upper rim 23 of the collar 22 of the propane tank 20. There may be a handle 33 integral with the outside front surface of the flange 32 to assist in opening and closing the lid 31. Integral with the outside rear surface of the flange 32 may be a hinge assembly 34 which may include two vertical side plates 35 both with corresponding openings 36 and an integral transverse connecting member 37. There may also be a vertical guide plate 38, in spaced apart relation to each side plate 35 and disposed between the vertical side plates 35. The guide plates 38 may also be integral with the transverse connecting member 37. The corresponding openings 36 may also be present in the guide plates 38. Both the vertical side plates 35 and the guide plates 38 may have upper rib-like extensions 39 that may be integral with and may project onto the top surface 40 of the lid 31 and may function to reinforce and strengthen the hinge assembly 34. (See FIGS. 4 through 8)

Figure 5:
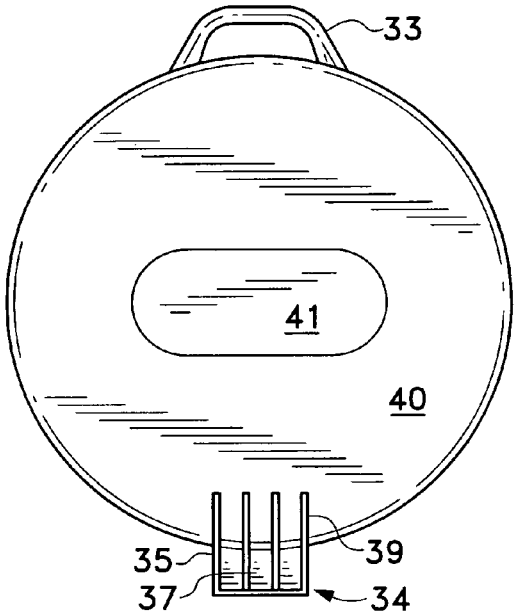
FIG. 5 is a top plan view of the lid.
Figure 6:
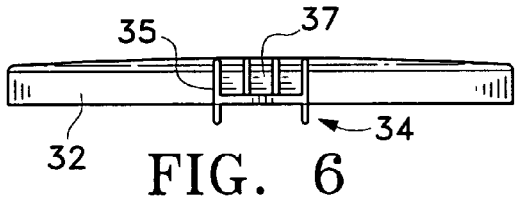
FIG. 6 is a rear elevational view of the lid.
Figure 7:
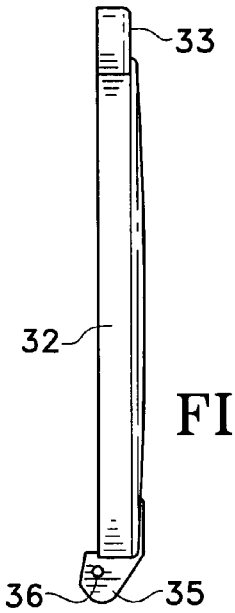
FIG. 7 is a is a side elevational view of the lid.
Figure 8:
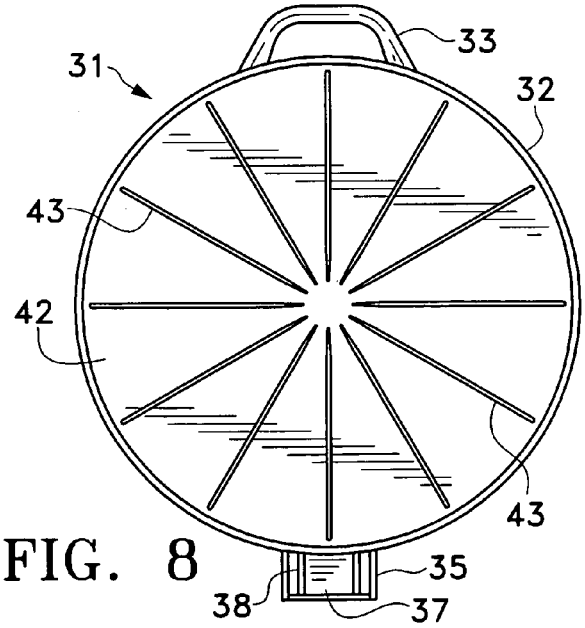
FIG. 8 is a bottom plan view of the lid.

There may be a flat area 41 on the top surface 40 of the lid 31 seen in FIG. 5 which may be used to contain any indicia that the manufacturer or purchaser may wish to display. Integral with the undersurface 42 of the lid 31 may be a series of radial ribs 43 that may be seen in FIG. 8. The ribs 43 may reinforce the lid 31 while enabling it to be constructed from a minimum of material without sacrificing strength or stability.

The hinge assembly 34 may be designed to cooperate with a pair of ears that may be present on the outer surface of the propane tank collar 22. The tanks of some manufacturers may have these ears and the tanks of others may not. However, even if present, the spacing and size of the ears may be different for each manufacturer's tank. If the collar of the tank has the appropriately sized and oriented ears the hinge assembly 34 may be attached directly to the collar using the cotter pin 54. If there are no ears on the collar, or the ears are not appropriately sized and/or oriented, an adapter may be needed. The cover assembly 30 of the present invention includes an adapter 50 that makes this assembly usable with the large commercial and residential propane tanks 20 of all current manufacturers. The adapter 50 may be attached to the outside surface of the collar 22 and may provide the ears 52, properly spaced and oriented to cooperate with the hinge assembly 34 of the lid 31. Once the adapter 50 is secured to the side of the collar 22, the hinge assembly 34 of the lid 31 may be connected to the adapter 50 using the cotter pin 54.

The adapter 50 may be a plate 51 that may be substantially planar but pliable enough to conform to the curvature of the collar 23 of the propane tank 20. The plate 51 may be sufficiently pliable to accommodate the curvatures of the tanks of different sizes so that one size adapter 50 may be used with all of the eight sizes of lid 31. The plate 51 may have two outwardly projecting vertical ears 52, integral with its outside surface. There may be corresponding apertures 53 suitably oriented in both ears 52 to communicate with the apertures 36 in the vertical plates 35 and the guide plates 38 of the hinge assembly 34. These features may be seen in FIGS. 9 through 12. The ears 52 may be configured to cooperate with the hinge assembly 34 such that each ear 52 may be disposed between a vertical side plate 35 and a guide plate 38 when the lid 31 is connected to the adapter 50. The adapter may be affixed to the side of the collar 22 of the propane tank 20 at the appropriate level so that the ears 52 may be accepted between the vertical plates 35 and the guide plates 38 of the hinge assembly 34 and the openings 36 in the guide plates 38 and the apertures 53 in the ears 52 may align perfectly. The cotter pin 54 (FIG. 1) may be inserted through the openings 38 and apertures 53 to attach the lid 31 to the adapter 50 and thereby to the collar 22 to enable the lid 31 to be easily pivoted opened or closed.

Figure 9:
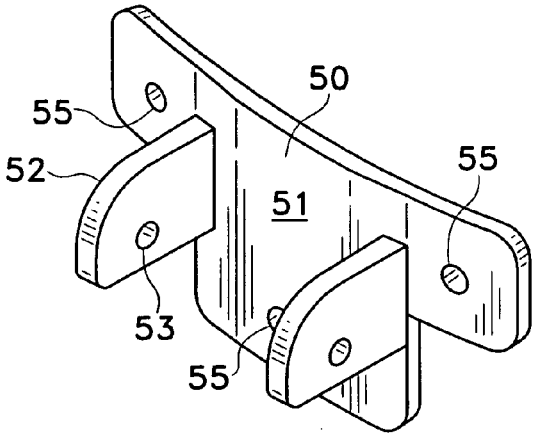
FIG. 9 is a front perspective view of the adapter.
Figure 10:
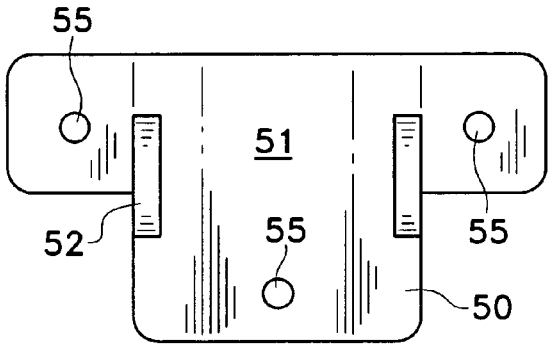
FIG. 10 is a front plan view of the adapter.
Figure 12:
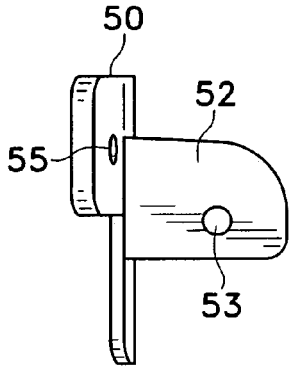
FIG. 12 is a side elevational view of the adapter.
Figure 11:
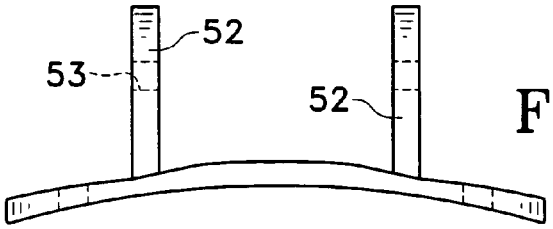
FIG. 11 is a top elevational view of the adapter.
Figure 14:
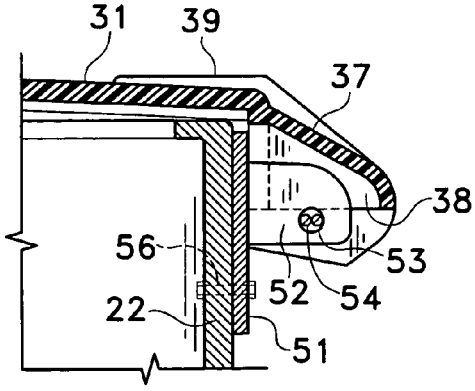
FIG. 14 is a sectional view through line 14-14 of FIG. 2.

There may be bores 55 in the plate 51 through which bolts or rivets 56 may be inserted to secure the plate 51 to the side of the collar 22. This may be seen in FIGS. 1 and 14. There may be two bores 55 along opposite ends of the upper portion of the plate 51 and a third bore 55 centered along the lower portion of the plate 51 (FIGS. 9 and 10). If bolts 56 are used, nuts 57 may cooperate to maintain the bolts in place. Other numbers or arrangements of the bores 55 may be used to accomplish the attachment. To attach the adapter 50 to the collar 22, holes 58 may have to be drilled through the collar 22 at appropriate locations. Instructions may accompany the cover assembly 30 to describe the procedure to properly place and drill the holes 58.

Figure 3:
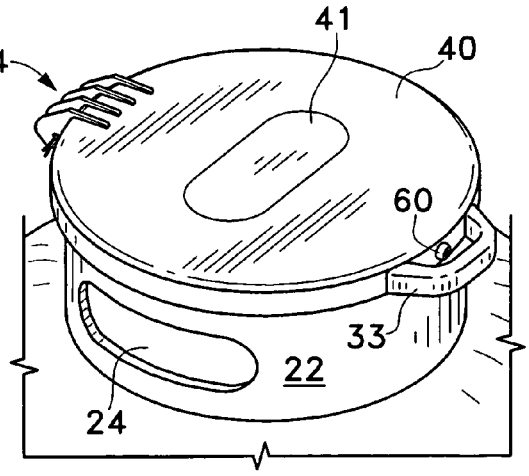
FIG. 3 is a front perspective view of the assembly of FIG. 2.
Figure 4:
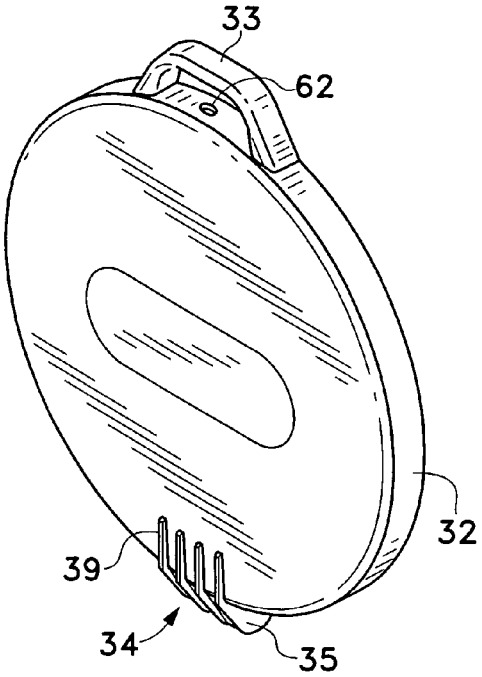
FIG. 4 is a top right perspective view of the lid.
Figure 13:
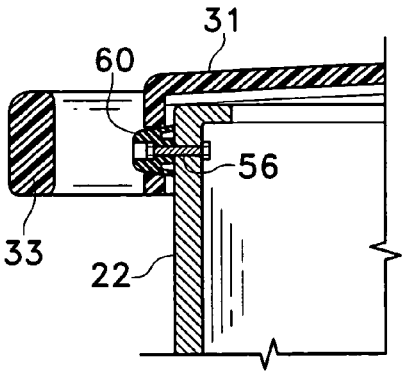
FIG. 13 is a sectional view through line 13-13 of FIG. 2.

Since the lid 31 may be relatively light-weight, it may be easily lifted and flap about in strong winds. To prevent this from happening, a fastening button 60 may be used. This button 60 may be affixed to the collar 22 at a point that is central to the handle 33 when the lid 31 is closed. (See FIG. 3) There may be an aperture 62 in the circular flange 32 of the lid 31 sized to readily accept the button 60 and centered between the two integral ends of the handle 33 as seen in FIG. 4. The cylindrical button 60 may have a substantially flat bottom and a domed top. There may be a central axial bore 61 through the button 60 for the placement of a bolt or rivet 56 with which to affix the button 60 to the collar 22. If a bolt 56 is used, a cooperating nut 57 may be used as a retainer. A hole 63 may be drilled in the collar 22 to accommodate the button 60. (See FIGS. 1 and 13)

The installation of the cover assembly 30 may be simple and quick. Even the drilling of the four holes through the collar 22 of the propane tank 20 for the attachment of the adapter 50 and the button 60 may not be complicated when the included instructions are followed. The instruction sheet may specify how and where these holes should be drilled. The collar 22 of a propane tank having the proper ears may still require that a hole be drilled to accommodate the button 60.

To affix the cover assembly 30 to the collar 22, the four holes may be drilled and the adapter 50 and button 60 attached using the bolts and nuts or rivets provided. The lid 31 may thereafter be brought toward the rim of the collar 22 and oriented such that the hinge assembly 34 slides over the ears 52 of the adapter 50 and the ears 34 slip between the vertical plates 35 and the guide plates 38. The cotter pin 54 may be inserted through the openings 36 in the plates 35, 38 and apertures 53 in the ears 52 and the lid 31 may be pivoted closed. As the lid 31 is closed the front edge of the lid 31 may be stopped by the button 60. A slight pull on the handle 33 or push on the edge of the lid 31 near the handle 33 may distort the lid 31 just enough to expand it over the button 60 such that the button 60 may be snapped into the aperture 62 in the circular flange 32 of the lid 31 to retain the lid 31 in closed orientation.

To open the lid 31, the handle may be grasped and slight pressure exerted by the thumb against the button 60 to distort the lid 31 just enough to expand it over the button 60, release the button 60 from the aperture 62 and free the lid 31 to pivot upward to the open position.

The lid 31 may be made from a plastic that may be substantially rigid but with the ability to distort just enough to enable it to be locked in place by the button 60 and thereafter opened. Polypropylene may work well, though other materials may be used. The lid 31 may be made in any of eight sizes ranging from approximately 14 inches (35.5 cm) to 16.5 inches (42 cm) in diameter to accommodate the existing large propane tanks, though the lid 31 may be made in any other desired size in keeping with the above specifications. The lid 31 may also be made in any desirable color or colors. The adapter 50 may also be made of polypropylene or of another suitable polymeric material. One size adapter may accommodate all eight of the sizes of the lid. The button 60 may be composed of a substantially rigid polymeric material.

While one embodiment of the present invention has been illustrated and described in detail, it is to be understood that this invention is not limited thereto and may be otherwise practiced within the scope of the following claims.

I claim:

1. A cover assembly for use with large commercial and residential propane tanks of a type that are free standing cylinders bounded by substantially flat upper and lower surfaces and having a cylindrical collar of lesser diameter than the cylinder permanently affixed to a central portion of the upper surface, said cover assembly comprising:

a lid configured to cover the inside of the cylindrical collar, said lid comprising a disc having a top surface, a bottom surface, and a downward facing annular flange integral with its outer edge, said annular flange configured to enclose the upper rim of the cylindrical collar, a handle, integral with and disposed on the front outer surface of the annular flange, and a hinge assembly integral with and disposed on the rear outer surface of the annular flange opposite the handle, said hinge assembly having communicating horizontally oriented apertures therethrough;

an adapter to enable the lid to be hingedly attached to the cylindrical collar, said adapter comprising a semi-rigid plate having at least two openings through which to attach said plate to the outside of the cylindrical collar and two vertical ears integral with and at right angles to said plate, said ears having horizontally oriented apertures therethrough and configured for communication with the horizontal apertures of the hinge assembly;

a pin configured to pass through the apertures in the hinge assembly and the apertures in the ears such that the lid can pivot upward to expose the interior of the cylindrical collar and can pivot downward to protect said interior; and a cylindrical button having a substantially flat bottom a domed top and an axial bore for attachment of the button to the cylindrical collar and an opening in the front of the annular flange of the lid configured to accept the button.

2. A cover assembly for use with large commercial and residential propane tanks as described in claim 1 wherein the hinge assembly further comprises extensions from the top thereof, said extensions forming ribs integral with the top surface of the disc to support and reinforce the hinge assembly.

3. A cover assembly for use with large commercial and residential propane tanks as described in claim 1 wherein said lid is composed of a semi-rigid material thereby enabling the lid to distort sufficiently for the annular flange to pass over the button and return after said button snaps into the opening in the front of the annular flange thereby maintaining the lid in closed orientation.

4. A cover assembly for use with large commercial and residential propane tanks as described in claim 1 further comprising appropriately placed holes drilled through the cylindrical collar of the propane tank and fasteners adapted to pass through the holes in the collar to retain the adapter and the button in fixed connection to the collar.

5. A cover assembly for use with large commercial and residential propane tanks of a type that are free standing cylinders bounded by substantially flat upper and lower surfaces and having a cylindrical collar of lesser diameter than the cylinder permanently affixed to a central portion of the upper surface, said cover assembly comprising:

a lid configured to cover the inside of the cylindrical collar and to enclose the upper rim of the cylindrical collar said lid comprising a disc having a top surface, a bottom surface, and a downward facing annular flange integral with its outer edge, said annular flange configured to enclose the upper rim of the cylindrical collar, a handle integral with and disposed on the front outer surface of the annular flange and a hinge assembly integral with and disposed on the rear outer surface of the annular flange opposite said handle;

an adapter to enable the lid to be hingedly attached to the cylindrical collar, said adapter having at least two holes therethrough for attachment to the cylindrical collar and two vertical ears for cooperation with said hinge assembly;

a pivot pin in communication with said hinge assembly and the ears of said adapter for enabling the lid to pivot opened and closed over the cylindrical collar;

a cylindrical button having an axial bore for attachment of said button to the cylindrical collar; and an opening in the front of the annular flange configured to accept the button, said lid being composed of a semi-rigid material thereby enabling the lid to distort sufficiently for the annular flange to pass over the button and to return after the button snaps into the opening in the front of the annular flange so as to maintain the lid in closed orientation.

6. A cover assembly for use with large commercial and residential propane tanks as described in claim 5 wherein the hinge assembly further comprises extensions forming ribs integral with the top surface of the disc and extending to the hinge assembly to support and reinforce said hinge assembly.

7. A cover assembly for use with large commercial and residential propane tanks as described in claim 5 wherein the adapter is composed of a semi-rigid material thereby enabling it to conform to the outer curvature of the cylindrical collar of all sizes of the propane tanks.

8. A cover assembly for use with large commercial and residential propane tanks as described in claim 5 wherein the adapter and the lid are composed of polymeric materials.

* * * * *